US009858873B2

(12) United States Patent
Wang et al.

(10) Patent No.: US 9,858,873 B2
(45) Date of Patent: Jan. 2, 2018

(54) LIQUID CRYSTAL DISPLAY PANEL

(71) Applicant: Century Technology (Shenzhen) Corporation Limited, Shenzhen (CN)

(72) Inventors: Ming-Tsung Wang, New Taipei (TW); Chia-Hua Huang, New Taipei (TW); Wen-Lin Mei, Shenzhen (CN); Hui Wang, Shenzhen (CN)

(73) Assignee: Century Technology (Shenzhen) Corporation Limited, Shenzhen (CN)

( * ) Notice: Subject to any disclaimer, the term of this patent is extended or adjusted under 35 U.S.C. 154(b) by 120 days.

(21) Appl. No.: 14/922,900

(22) Filed: Oct. 26, 2015

(65) Prior Publication Data

US 2017/0061916 A1 Mar. 2, 2017

(30) Foreign Application Priority Data

Aug. 28, 2015 (CN) ..... 2015 1 0538200

(51) Int. Cl.
*G09G 5/00* (2006.01)
*G09G 3/36* (2006.01)

(52) U.S. Cl.
CPC ..... *G09G 3/3611* (2013.01); *G09G 3/3677* (2013.01); *G09G 2310/067* (2013.01); *G09G 2320/0219* (2013.01); *G09G 2320/0223* (2013.01); *G09G 2320/0247* (2013.01)

(58) Field of Classification Search
CPC ..... G09G 3/3677; G09G 3/3611
USPC ..... 345/212
See application file for complete search history.

(56) References Cited

U.S. PATENT DOCUMENTS

2008/0192032 A1* 8/2008 Park ..... G09G 3/3677 345/204
2008/0225035 A1* 9/2008 Hsu ..... G09G 3/3648 345/212
2009/0189883 A1* 7/2009 Chung ..... G09G 3/3674 345/213
2010/0123703 A1* 5/2010 Guo ..... G09G 3/3648 345/211
2010/0194735 A1* 8/2010 Ohtsubo ..... G09G 3/3666 345/211
2010/0245333 A1* 9/2010 Hsu ..... G09G 3/3648 345/211
2012/0262497 A1* 10/2012 Chang ..... G09G 3/3674 345/211

FOREIGN PATENT DOCUMENTS

CN 101644867 2/2010

* cited by examiner

*Primary Examiner* — Adam J Snyder
(74) *Attorney, Agent, or Firm* — ScienBiziP, P.C.

(57) ABSTRACT

A flicker-reduced liquid crystal display panel diminishing resistance-capacitance phenomena includes a plurality of parallel scanning lines and a plurality of parallel data lines, all lines intersecting with each other at the crosses. The liquid crystal display panel further includes a pulse control circuit and a gate driver. The pulse control circuit receives a pulse signal and reduces the time of the pulse signal under control of a control signal, the control signal controlling the start and finish of the time reduction. A reduced pulse signal is output. The gate driver receives the pulse signal which is output and issues scanning signals to the plurality of scanning lines.

8 Claims, 6 Drawing Sheets

LIQUID CRYSTAL DISPLAY PANEL

CROSS-REFERENCE TO RELATED APPLICATIONS

This application claims priority to Chinese Patent Application No. 201510538200.7 filed on Aug. 28, 2015 in the China Intellectual Property Office, the contents of which are incorporated by reference herein.

FIELD

The subject matter herein generally relates to a liquid crystal displays.

BACKGROUND

A liquid crystal display panel can include a gate driver and a plurality of thin film transistors. The gate driver outputs gate driving signals to control the plurality of thin film transistors via a plurality of scanning lines. However, a parasitic capacitance and resistance (RC) of the scanning lines may cause an RC delay. The RC delay makes for picture flicker.

BRIEF DESCRIPTION OF THE DRAWINGS

Implementations of the present technology will now be described, by way of example only, with reference to the attached figures, wherein.

DETAILED DESCRIPTION

Figure 1:
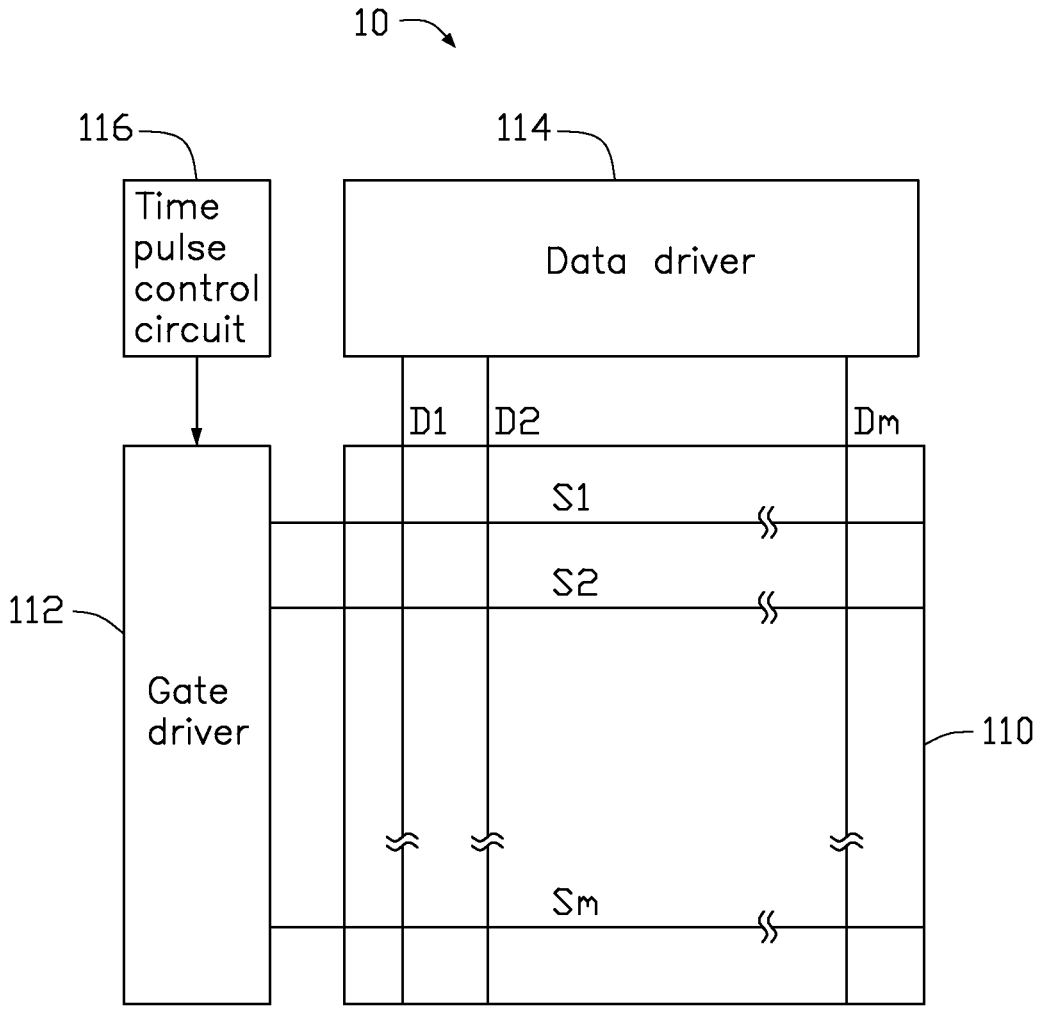
FIG. 1 is a block diagram of a liquid crystal display panel including a gate pulse control circuit according to a first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

FIG. 1 illustrates a liquid crystal display panel 10 of a first embodiment. The liquid crystal display panel 10 can include a thin film transistor array 110, a gate driver 112, a data driver 114, and a time controller 116. The liquid crystal display panel 10 can further include a plurality of scanning lines S1-Sn and a plurality of data lines D1-Dm. The scanning lines S1-Sn are parallel to each other. The data lines D1-Dm are parallel to each other, and each one intersects with the scanning lines S1-Sn. The data lines D1-Dm and the scanning lines S1-Sn define multiple intersections where the data lines D1-Dm cross the scanning lines S1-Sn. Each thin film transistor of the thin film transistor array 110 is arranged at one intersection of the data lines D1-Dm and the scanning lines S1-Sn. In the illustrated embodiment, the liquid crystal display panel 10 can be an In-Plane Switching panel or Fringe Field Switching panel.

Figure 2:
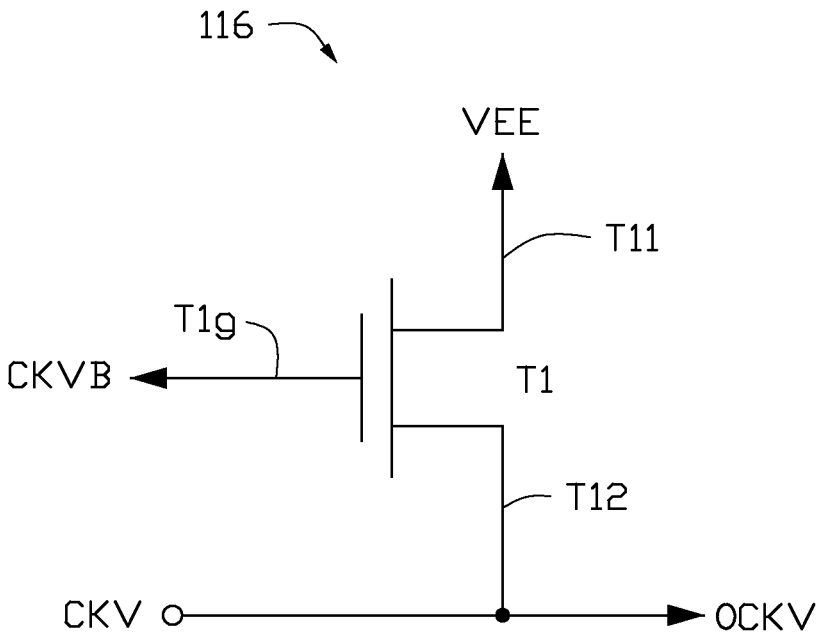
FIG. 2 is a circuit diagram of the gate pulse control circuit of the liquid crystal display panel of FIG. 1.
Figure 3:
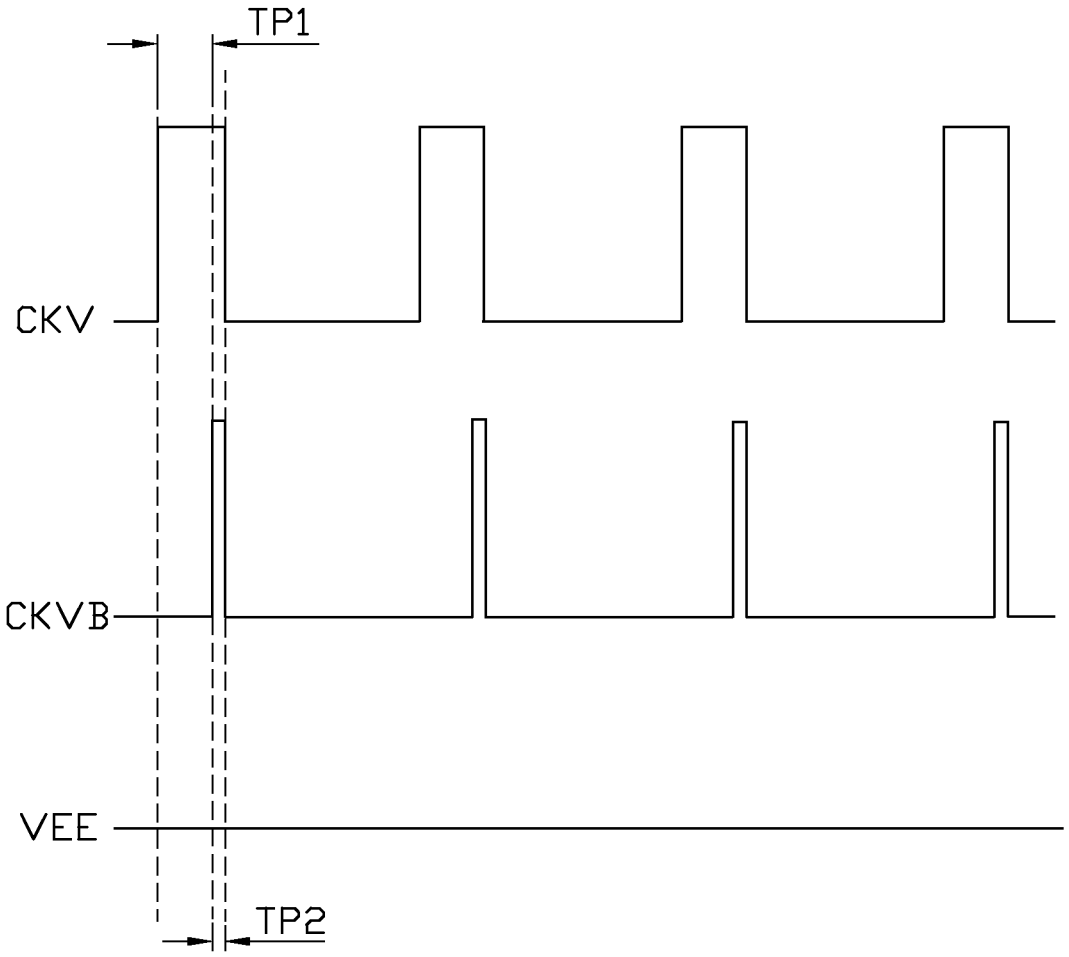
FIG. 3 is a waveform diagram of the gate pulse control circuit of FIG. 2.

FIGS. 2-3 illustrate the pulse control circuit 116 receiving a pulse signal CKV and chamfering the pulse signal CKV, based on a control signal CKVB, to output a pulse signal OCKV. The control signal CKVB controls a time period of diminution of the pulse signal CKV. The gate driver 112 receives the pulse signal OCKV and outputs a plurality of scanning signals to the plurality of scanning lines S1-Sn.

The pulse control circuit 116 can include a first transistor T1. The first transistor T1 can include a control terminal T1*g*, a first conductive terminal T11, and a second conductive terminal T12. The control terminal T1*g* receives the control signal CKVB. The first conductive terminal T11 receives a chamfering signal VEE1. The second conductive terminal T12 receives the pulse signal CKV and outputs the pulse signal OCKV. In the illustrated embodiment, the pulse signal CKV may be square wave or half square wave and have a first high level magnitude and a first low level magnitude. The voltage of the first high level magnitude is 18V, and the voltage of the first low level magnitude is −8V. The chamfering signal VEE1 pulls down the pulse signal CKV and outputs a diminished or time-reduced signal.

During a first time period TP1, the control signal CKVB is logic-low, which causes the first transistor T1 to be turned off. A waveform of the pulse output signal OCKV is same as that of a waveform of the pulse signal CKV. During a second time period TP2, the control signal CKVB is logic-high, which causes the first transistor T1 to be turned on. The chamfering signal VEE1 pulls down the pulse signal CKV to form the pulse signal OCKV. In the illustrated embodiment, a duration of the first time period TP1 is greater than a duration of the second time period TP2. The control signal CKV is logic-high throughout the first and second time periods TP1 and TP2. In the illustrated embodiment, when the control signal CKVB converts to logic-low from logic-high, the pulse signal CKV converts simultaneously to logic-low from logic-high. Therefore, picture flicker of the liquid crystal display panel is reduced.

Figure 4:
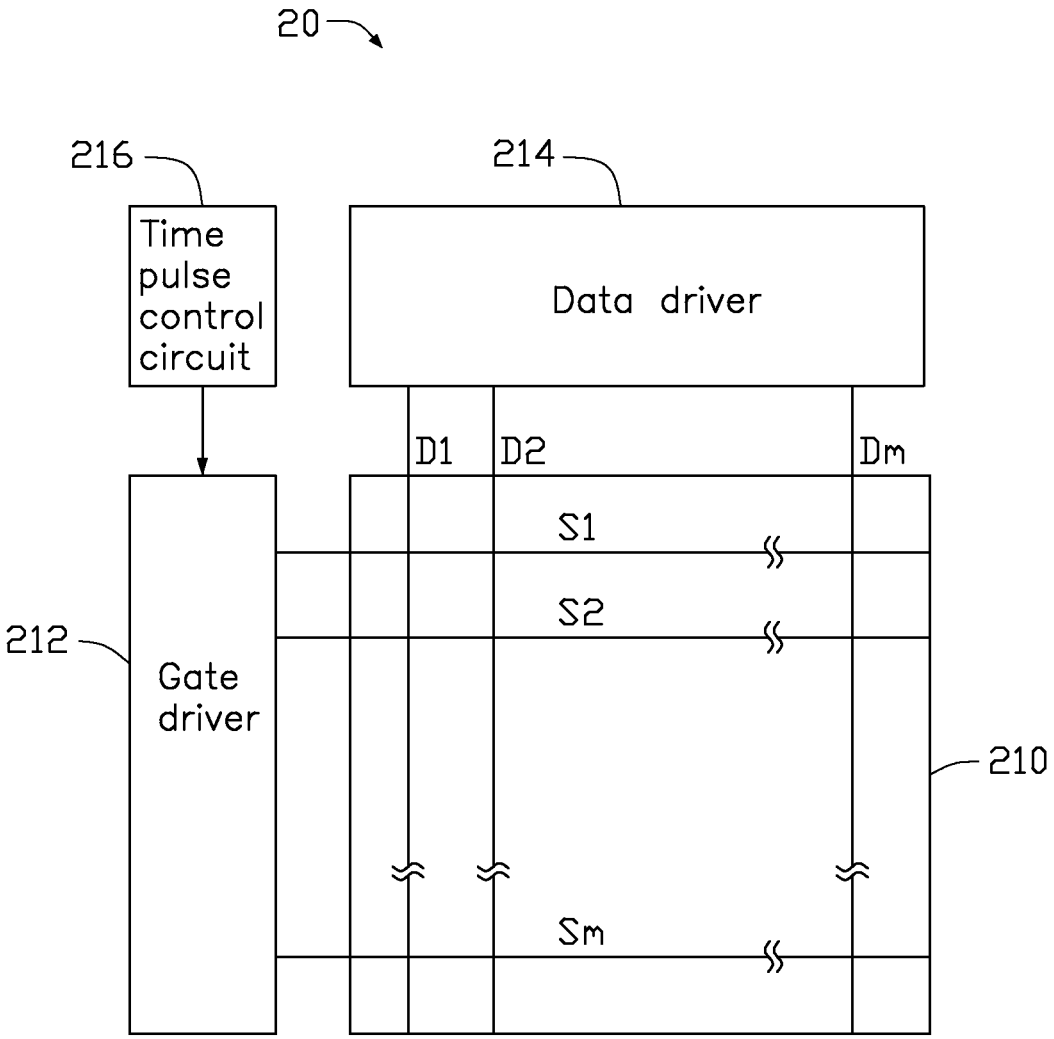
FIG. 4 is a block diagram of the liquid crystal display panel including a gate pulse control circuit according to a second embodiment of the present disclosure.

FIG. 4 illustrates a liquid crystal display panel 20 of a second embodiment. The liquid crystal display panel 20 can include a thin film transistor array 210, a gate driver 212, a data driver 214, and a time controller 216. The liquid crystal display panel 20 can further include a plurality of scanning lines S1-Sn and a plurality of data lines D1-Dm. The scanning lines S1-Sn are parallel to each other. The data lines D1-Dm are parallel to each other, and each one intersects with the scanning lines S1-Sn. The data lines D1-Dm and the scanning lines S1-Sn define multiple intersections where the data lines D1-Dm cross the scanning lines S1-Sn. A thin film transistor of the thin film transistor array 210 is arranged at each intersection of the data lines D1-Dm and the scanning lines S1-Sn. In the illustrated embodiment, the liquid crystal display panel 20 can be an In-Plane Switching panel or Fringe Field Switching panel.

Figure 5:
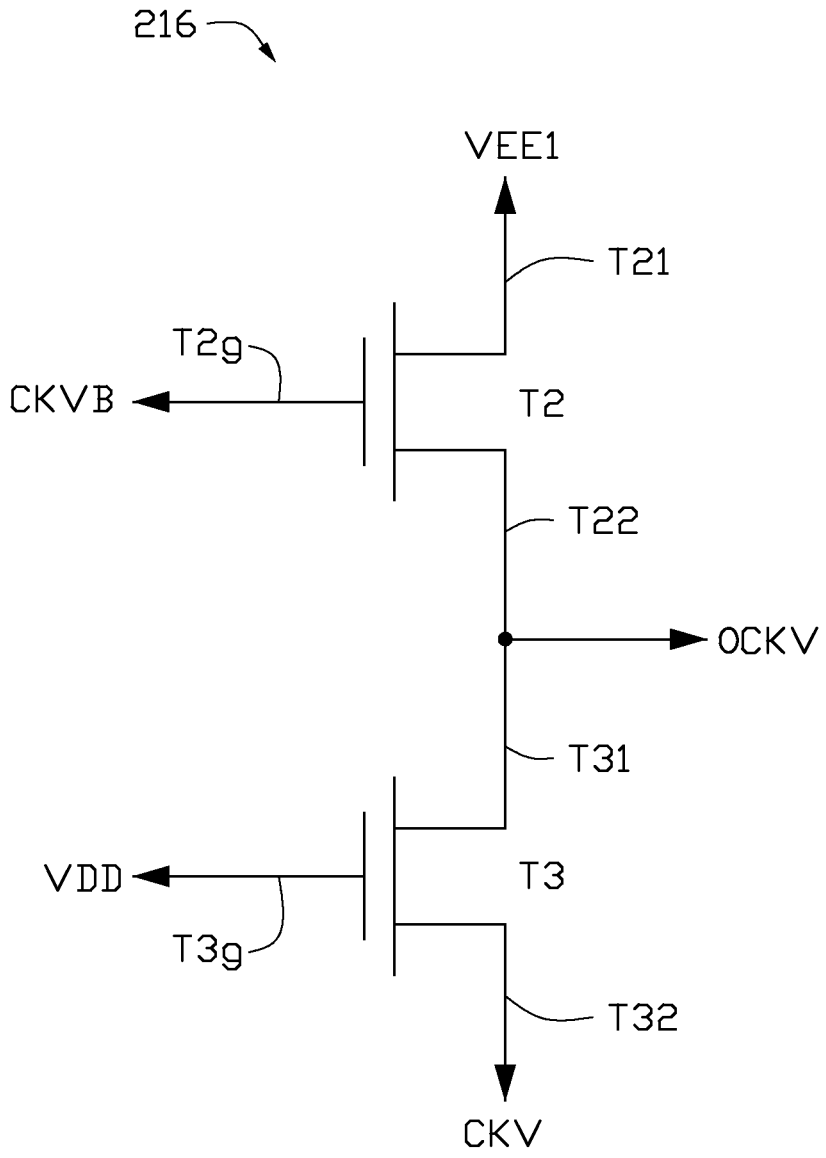
FIG. 5 is a circuit diagram of the gate pulse control circuit of the liquid crystal display panel of FIG. 4.
Figure 6:
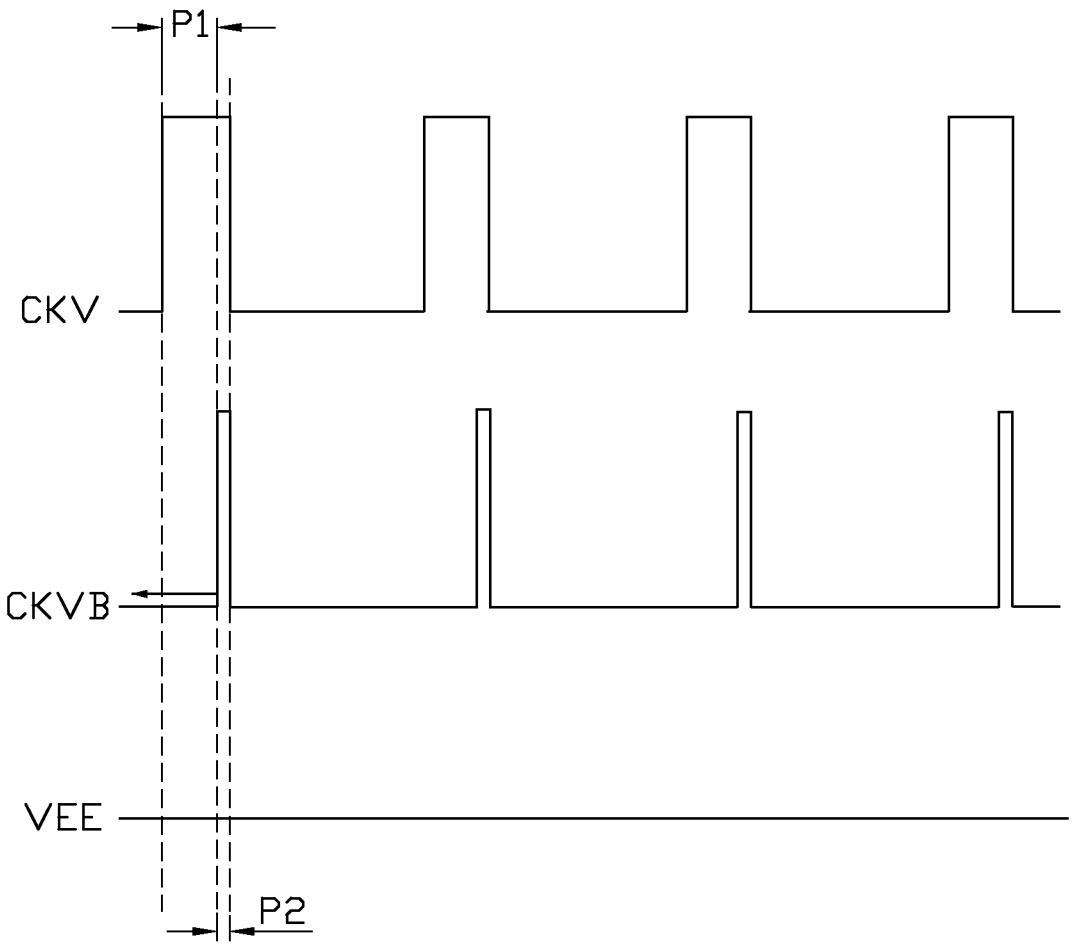
FIG. 6 is a waveform diagram of the gate pulse control circuit of FIG. 5.

FIGS. 5-6 illustrate the pulse control circuit 216 receiving a pulse signal CKV and chamfering the pulse signal CKV under control of a control signal CKVB, to output a pulse signal OCKV. The control signal CKVB controls a time period of diminution of the pulse signal CKV. The gate driver 212 receives the pulse signal OCKV and outputs a plurality of scanning signals to the plurality of scanning lines S1-Sn.

The pulse control circuit 216 can include a second transistor T2 and a third transistor T3. The second transistor T2 can include a control terminal T2*g*, a first conductive terminal T21, and a second conductive terminal T22. The third transistor T3 can include a control terminal T3*g*, a first conductive terminal T31, and a second conductive terminal T32. The control terminal T2*g* of the second transistor T2 receives the control signal CKVB. The first conductive terminal T21 of the second transistor T2 receives a diminution signal VEE. The second conductive terminal T22 is electrically coupled to the first conductive terminal T31 of the third transistor T3. The second conductive terminal T32 of the third transistor T3 receives pulse signal CKV. The control terminal T3*g* of the third transistor T3 receives a second control signal VDD. A node between the second conductive terminal T22 of the second transistor T2 and the first conductive terminal T31 of the third transistor T3 outputs the pulse signal OCKV. In the illustrated embodiment, the pulse signal CKV may be full or half square wave and have a first high level logic and a first low level logic. The voltage of the first high level is 18V, and the voltage of the first low level is −8V. The diminution signal VEE is −10V and pulls down the pulse signal CKV.

During a first time period P1, the control signal CKVB is at logic-low, which causes the second transistor T2 to be turned off. The second control signal VDD is at logic-high, which causes the third transistor T3 to be turned on. A waveform of the pulse signal OCKV is same as that of a waveform of the pulse signal CKV. During a second time period P1, the control signal CKVB is at logic-high, which causes the second transistor T2 to be turned on. The second control signal VDD is at logic-high, which causes the third transistor T3 to be turned on. The chamfering signal VEE pulls down the pulse signal CKV to form the pulse signal OCKV. Therefore, picture flicker of the liquid crystal display panel is reduced.

It is to be understood that even though numerous characteristics and advantages of the present embodiments have been set forth in the foregoing description, together with details of the structures and functions of the embodiments, the disclosure is illustrative only; and changes may be in detail, especially in the matter of arrangement of parts within the principles of the embodiments, to the full extent indicated by the broad general meaning of the terms in which the appended claims are expressed.

What is claimed is:

1. A liquid crystal display panel comprising:

a plurality of scanning lines parallel to each other;

a plurality of data lines parallel to each other and configured to isolatedly intersect with the scanning lines;

a pulse control circuit configured to receive a pulse signal and chamfer the pulse signal based on a first control signal, which controls a time period of diminution of the pulse signal to output a pulse output signal; and a gate driver configured to receive the pulse output signal and output a plurality of scanning signals to the plurality of scanning lines;

the pulse control circuit comprises a first transistor and a second transistor; the first transistor is controlled by the first control signal and the second transistor is controlled by a second control signal different from the first control signal; the second control signal is a constant high level; when the first transistor turns off and the second transistor turns on, the second transistor directly outputs the pulse signal as the pulse output signal; when the first transistor turns on and the second transistor turns on, the first transistor chamfer the pulse signal outputted by the second transistor as the pulse output signal.

2. The liquid crystal display panel of claim 1, wherein the first transistor comprises a control terminal, a first conductive terminal, and a second conductive terminal, the second transistor comprises a control terminal, a first conductive terminal, and a second conductive terminal; and the control terminal of the first transistor receives the first control signal, the first conductive terminal of the first transistor receives a chamfering signal, the second conductive terminal is electrically coupled to the first conductive terminal of the second transistor, the second conductive terminal of the second transistor receives pulse signal, the control terminal of the second transistor receives the second control signal; and the node between the second conductive terminal of the first transistor and the first conductive terminal of the second transistor outputs the pulse output signal.

3. The liquid crystal display panel of claim 1, wherein during a first time period, the first control signal is at logic-low which causes the first transistor to be turned off, the second control signal is at logic-high which causes the second transistor to be turned on; during a second period, the first control signal is at logic-high which causes the first transistor to be turned on, the second control signal is at logic-high which causes the second transistor to be turned on, the chamfering signal pulls down the pulse signal to form the pulse output signal.

4. The liquid crystal display panel of claim 1, wherein the pulse signal is a square wave and have a first high level magnitude and a first low level magnitude, and a voltage of the first high level is 18V, and a voltage of the first low level is −8V, and a voltage of the chamfering signal is −10V.

5. A liquid crystal display panel comprising:

a plurality of scanning lines parallel to each other;

a plurality of data lines parallel to each other and isolatedly intersect with the scanning lines;

a pulse control circuit receiving a pulse signal and chamfering the pulse signal under control of a first control signal, which controls a time period of diminution of the pulse signal to output a pulse output signal; wherein the pulse control circuit comprises a first transistor and a second transistor to chamfer the pulse signal;

a gate driver receiving the pulse output signal and outputs a plurality of scanning signals to the plurality of scanning lines;

wherein the second transistor keeps in a turned on state based on a second control signal, and always directly outputs the pulse signal to a node between the first transistor and the second transistor.

6. The liquid crystal display panel of claim 5, wherein the first transistor comprises a control terminal, a first conductive terminal, and a second conductive terminal, the second transistor comprises a control terminal, a first conductive terminal, and a second conductive terminal; and the control terminal of the first transistor receives the first control signal, the first conductive terminal of the first transistor receives a chamfering signal, the second conductive terminal is electrically coupled to the first conductive terminal of the second transistor, the second conductive terminal of the second transistor receives the pulse signal, the control terminal of the second transistor receives the second control signal; and the node between the second conductive terminal of the first transistor and the first conductive terminal of the second transistor outputs the pulse output signal.

7. The liquid crystal display panel of claim 6, wherein during a first time period, the first control signal is at logic-low which causes the first transistor to be turned off, the second control signal is at logic-high which causes the second transistor to be turned on; during a second time period, the first control signal is at logic-high which causes the first transistor to be turned on, the second control signal is at logic-high which causes the second transistor to be turned on, the chamfering signal pulls down the pulse signal to form the pulse output signal.

8. The liquid crystal display panel of claim 6, wherein the pulse signal is a square wave and have a first high level magnitude and a first low level magnitude, and a voltage of the first high level is 18V, and a voltage of the first low level is −8V, and a voltage of the chamfering signal is −10V.

* * * * *